US011125546B2

(12) United States Patent
Hucker

(10) Patent No.: US 11,125,546 B2
(45) Date of Patent: Sep. 21, 2021

(54) FUSE SYSTEM

(71) Applicant: BAE SYSTEMS plc, London (GB)

(72) Inventor: Martyn John Hucker, Glascoed Usk (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 16/977,683

(22) PCT Filed: Mar. 1, 2019

(86) PCT No.: PCT/GB2019/050573

§ 371 (c)(1),
(2) Date: Sep. 2, 2020

(87) PCT Pub. No.: WO2019/171028

PCT Pub. Date: Sep. 12, 2019

(65) Prior Publication Data

US 2020/0393230 A1 Dec. 17, 2020

(30) Foreign Application Priority Data

Mar. 7, 2018 (EP) ..... 18275037
Mar. 7, 2018 (GB) ..... 1803665

(51) Int. Cl.
*F42C 15/32* (2006.01)
*F42C 15/40* (2006.01)

(52) U.S. Cl.
CPC ..... *F42C 15/32* (2013.01); *F42C 15/40* (2013.01)

(58) Field of Classification Search
CPC ..... F42C 15/32; F42C 15/40
USPC ..... 102/206
See application file for complete search history.

(56) References Cited

U.S. PATENT DOCUMENTS 3,851,531 A * 12/1974 White ..... G01P 15/08 73/510
3,866,535 A * 2/1975 Hedeen ..... F42C 15/29 102/224
3,919,941 A * 11/1975 Breed ..... F42C 15/285 102/250
4,188,886 A * 2/1980 Brauer ..... F42C 15/29 102/223
6,167,809 B1 * 1/2001 Robinson ..... F42C 15/184 102/235

(Continued)

FOREIGN PATENT DOCUMENTS

DE 2426237 A1 12/1975
GB 2380782 A 4/2003
WO 2019171028 A1 9/2019

OTHER PUBLICATIONS

International Preliminary Report on Patentability for PCT Application No. PCT/GB2019/050573, dated Sep. 17, 2020. 7 pages.

(Continued)

*Primary Examiner* — Joshua E Freeman
(74) *Attorney, Agent, or Firm* — Finch & Maloney PLLC

(57) ABSTRACT

According to a first aspect of the present invention, there is provided a fuse system for a projectile for a ranged weapon, the fuse system comprising: a pressure sensor system for sensing an air pressure of an environment in which the fuse system is present; a control system arranged to receive a signal from the pressure sensor system, and to at least initiate arming of the fuse system conditional on the received signal.

20 Claims, 2 Drawing Sheets

(56) References Cited

U.S. PATENT DOCUMENTS

Figure 1:
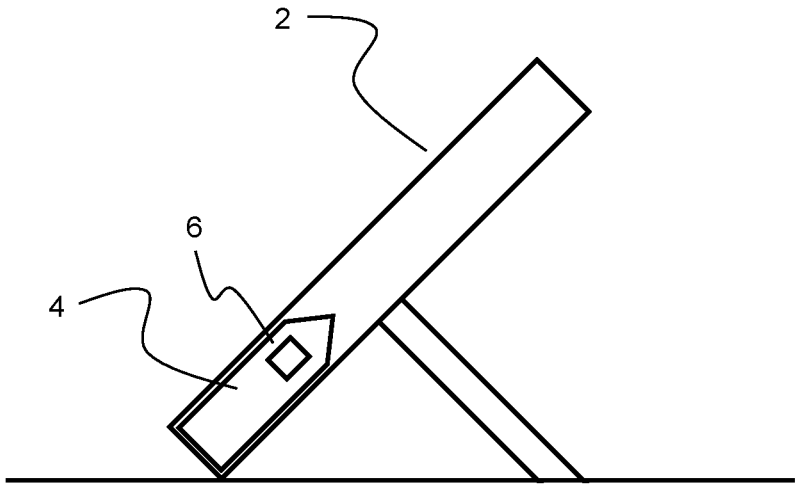

| | | | | |
|---|---|---|---|---|
| 6,705,231 | B1 * | 3/2004 | Zacharin | F42C 15/22 102/231 |
| 6,967,614 | B1 * | 11/2005 | Wardell | F42C 15/40 342/13 |
| 7,240,617 | B1 * | 7/2007 | Bonbrake | F42C 15/40 102/215 |
| 2008/0210115 | A1 * | 9/2008 | Zinell | F42C 15/005 102/216 |
| 2012/0291613 | A1 * | 11/2012 | Rastegar | F42C 14/06 89/1.54 |
| 2018/0007474 | A1 * | 1/2018 | Cargill | H04R 19/005 |
| 2018/0055387 | A1 * | 3/2018 | Takahashi | A61B 5/02108 |
| 2018/0105417 | A1 * | 4/2018 | Seddon | G01L 9/0055 |
| 2021/0113402 | A1 * | 4/2021 | Wijesundara | A47C 7/142 |

OTHER PUBLICATIONS

International Search Report and Written Opinion for PCT Application No. PCT/GB2019/050573, dated May 21, 2019. 9 pages.
GB Search Report under Section 17(5) for GB Application No. 1803665.7 dated May 31, 2018. 3 pages.
Extended European Search Report for EP Application No. 18275037.2 dated Sep. 5, 2018. 7 pages.

* cited by examiner

FUSE SYSTEM

The present invention relates generally to a fuse system for a projectile, and to related methodology, and to a projectile comprising such a fuse system.

Fuse systems for projectiles are known. A fuse system is used in the activation or detonation of a projectile's explosive material or similar. There are often strict safety requirements associated with the design, operation or implementation of such fuse systems, for example to ensure that a fuse system is not inadvertently or unintentionally activated or armed.

For instance, according to at least one safety standard, it is important, or perhaps even essential in some examples, that two independent environmental features or properties are used to initiate arming in a fuse system of a projectile. Typically, these environmental features are indicative of the projectile being launched (i.e. fired), or being in-flight, such that the projectile cannot explode in advance of such firing, or in advance of being in-flight. That is, the projectile cannot explode or otherwise be armed while in storage, or prior to use, or similar.

A feature consistent with firing or in-flight states of projectiles is that at some point in the firing, which leads to the in-flight state, a significant acceleration or force is applied to the projectile and its fuse system. This results in an associated setback (e.g. force or acceleration), which can be sensed, and used as part of the arming or initiation of the arming of the fuse system of the projectile. However, typically a second or at least independent environmental feature also needs to be sensed.

Many projectiles spin during launch and flight, for example to increase or maintain stability of the projectile during flight. This spinning can be sensed, and used in the arming or the initiation of the arming of the fuse system of the projectile. This is because the projectile and its fuse system will not be spinning, or at least spinning to an extent indicative of firing or flight, before firing or flight. In many circumstances, the detection of spinning of the fuse system (that is, about a longitude and axis along which the projectile is launched (i.e. fired) or flies) might be satisfactory, and even ideal. However, many projectiles do not spin during firing or flight, for example mortar bombs or smoothbore rounds. Regardless, the detection of spinning might not always be desirable or possible, or at least it may be desired to provide some form of alternative to the sensing of the spinning. For example a simpler sensing technique might be useful.

In another example, the fuse system might comprise a wind-driven turbine which might be used to sense air flow (and perhaps even provide power) for arming of the fuse system, for example when air flow is indicative of launch or flight. However, these turbine-based devices are typically quite expensive, and can introduce undesirable aerodynamic drag or other effects on the projectile, and can at the very least limit range of the projectile.

In another example, some fuse systems rely on an operator removing a physical safety pin in order to unlock an arming mechanism of the fuse system. However, the need for an operator to intervene in order to initiate the arming is arguably not within strict compliance with certain safety standards. For one reason, removal of the pin is not inherently associated with projectile launch or firing conditions. For example, the removal is not directly linked with launch or flight, and so the removal might occur, deliberately or accidentally, well in advance or completely separate to any launch or flight condition.

As already described above, air flow around and about the projectile and its fuse system may be used to initiate arming of the projectile, for example by way of rotation of a wind turbine or similar. Other air flow or pressure sensing implementations are known. These implementations include fuse systems comprising or in connection with mechanical arrangements, which are moved from a first physical position to a second physical position when an air flow or air pressure around or about the projectile and its fuse system reaches a particular threshold. For instance, a fuse system might comprise a mechanical linkage and bias component, and when the projectile and its fuse system is launched the air pressure is such that the bias component is overcome and the mechanical component is moved from one position to another position to initiate the arming. These known implementations are entirely mechanical, and typically require significant air pressures or speeds to arm the associated fuse system. For example, and typically, the dynamic pressures required for these implementations to operate are of the order of greater than 300 kPa, which is typically 5-6 times the maximum pressure generated under, for instance, the flight of a typical mortar bomb (e.g. which is typically 1.5 kPa-55 kPa). So, such mechanically sensed and mechanically implemented pressure-based fuse systems are quite crude, and not broadly applicable to a wide range of projectiles. Also, the crude mechanical nature of the systems might be susceptible to extremes in environmental conditions, for example, heat or cold, or forces during launch, or prolonged storage time, and may, as a result, fail under such extremes.

It is an example aim of an example embodiment of the present invention to at least partially avoid or overcome one or more disadvantages of the prior art, as discussed above or elsewhere, or to at least provide an alternative to existing fuse systems and related methodologies.

According to a first aspect of the present invention, there is provided a fuse system for a projectile for a ranged weapon, the fuse system comprising: a pressure sensor system for sensing an air pressure of an environment in which the fuse system is present; a control system arranged to receive a signal from the pressure sensor system, and to at least initiate arming of the fuse system conditional on the received signal.

The condition for arming the fuse system may be when the sensed pressure, or the related signal received from the pressure sensor system, is at or above a threshold which at least implies that the projectile is in a launched or launching state.

The pressure sensor system may be arranged to sense a static air pressure of an environment in which the fuse system is present; and/or is arranged to sense a dynamic air pressure of an environment in which the fuse system is present.

The pressure sensor system may be arranged to sense a difference between a static and dynamic air pressure of an environment in which the fuse system is present.

Therein the pressure sensor system may comprises a pitot-static system.

The pressure sensor system may comprise a MEMS pressure sensor.

The pressure sensor system may comprise one or more ports and/or conduits for facilitating fluid communication with an external environment in which the fuse system is present.

The control system may be arranged to at least initiate arming of the fuse system based on two conditions being met. In one example, a first condition is based on the received signal from the pressure sensor system.

The control system may be arranged to at least initiate arming of the fuse system based on two conditions being met. In one example, a second condition is based on a signal received from a setback sensor system. Optionally, the second condition for initiating arming of the fuse system is when the sensed setback, or the related signal received from the setback sensor system, is at or above a threshold which at least implies that the projectile is in a launched or launching state.

The signal may be an electrical signal.

The fuse system may occupy a volume of less than or equal to 10 $cm^3$, or less than or equal to 5 $cm^3$.

The pressure sensor system may occupy a volume of less than or equal to 5 $cm^3$, or less than or equal to 1 $cm^3$.

According to a second aspect of the present invention, there is provided a projectile for a ranged weapon, the projectile comprising the fuse system of as aspect of the invention.

The projectile may be a mortar bomb.

According to a third aspect of the present invention, there is provided method of at least initiating arming of a fuse system of a projectile for a ranged weapon, the method comprising: detecting an air pressure of an environment in which the fuse system is present, using a pressure sensor system; and at least initiating arming of the fuse system conditional on a signal received from the pressure sensor system.

It will be appreciated that one or more features of one aspect of the invention may be used in combination with, or indeed in place of, one or more features of another aspect of the invention, unless such combination or replacement will be understood by the skilled person after reading this disclosure to be mutually exclusive. In particular, any feature discussed in relation to an apparatus aspect may, of course, be used in combination with a method aspect. Any feature discussed in relation to a method aspect may, of course, be used in combination with an apparatus aspect.

Figure 2:
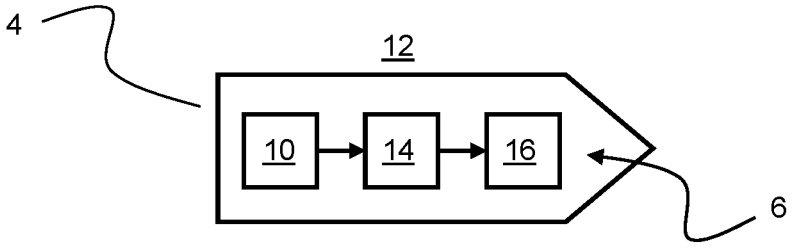
Figure 3:
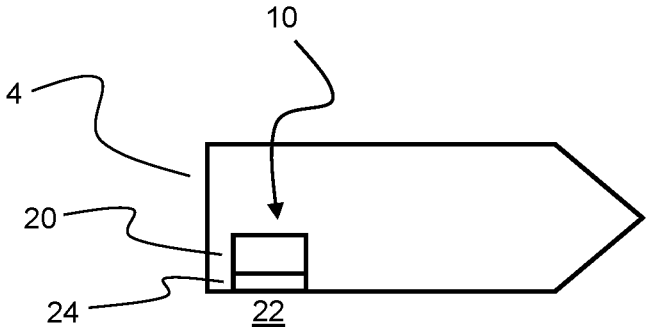
Figure 4:
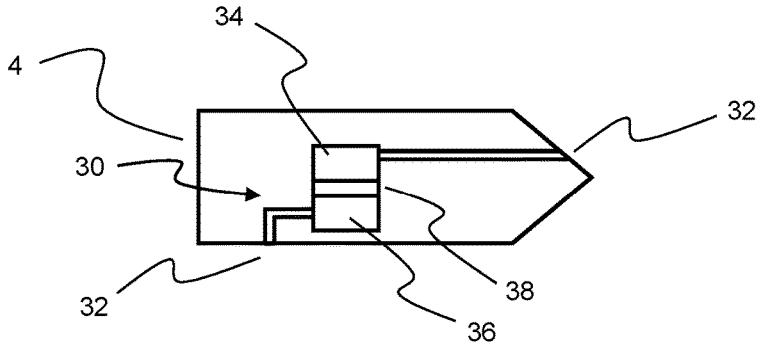
Figure 5:
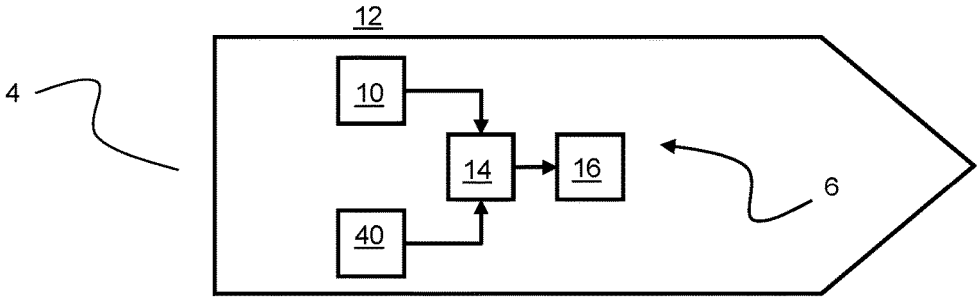
Figure 6:
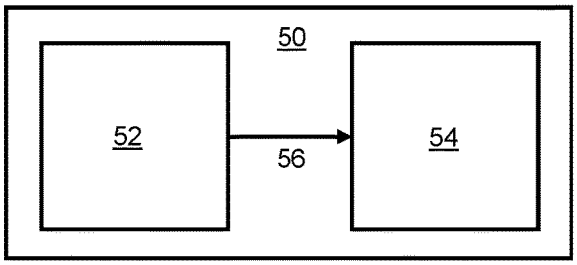
Figure 7:
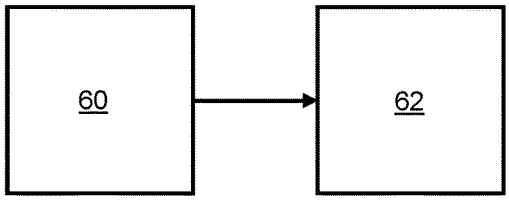

For a better understanding of the invention, and to show how embodiments of the same may be carried into effect, reference will now be made, by way of example, to the accompanying diagrammatic Figures in which:

FIG. 1 schematically depicts a ranged weapon and an associated projectile for that weapon, in accordance with an example embodiment;

FIG. 2 schematically depicts the projectile of FIG. 1 and its fuse system, according to an example embodiment;

FIGS. 3 and 4 depict different example implementations of a fuse system according to example embodiments;

FIG. 5 schematically depicts operating principles associated with a fuse system according to example embodiments;

FIG. 6 depicts general apparatus principles associated with example embodiments of the present invention; and FIG. 7 depicts general method principles associated with example embodiments of the present invention.

FIG. 1 schematically depicts a ranged weapon 2, that is, a weapon for use in firing a projectile over a distance. The ranged weapon 2 in FIG. 1 is loosely depicted as a mortar or mortar tube, but of course could take one of a number of different forms, for example a tank, artillery, self-propelled artillery, a gun battery, and so on. The projectile 4 will typically be launched (i.e. fired) along a barrel, tube, or bore of the weapon 2 before leaving the ranged weapon 2.

The ranged weapon 2 could be fixed in position. The ranged weapon 2 could be temporarily fixed in position. The ranged weapon 2 could be moveable.

After firing or launching, and having left the ranged weapon 2, the projectile 4 is completely un-propelled. This is in contrast with a missile or rocket or the like. In other words, after firing or launching, and before impact, the projectile 4 is generally subjected only substantially to forces of gravity and/or air resistance and similar. The projectile 4 is free from/does not comprise a propulsion system. The projectile 4 is not self-propelled.

As discussed above, the projectile 4 will generally or typically comprise a fuse system 6. The fuse system 6 will typically be used to initiate the detonation of, or detonate, an explosive substance or similar forming part of the projectile 4.

Also as discussed above, it is desirable to provide a fuse system which overcomes one or more disadvantages of the prior art, or at least provides a viable alternative to existing fuse systems. In accordance with the present invention, it has been realised that this can be achieved in a relatively simple, yet extremely powerful and flexible manner.

In accordance with an example embodiment, there is provided a fuse system for a projectile for a ranged weapon. The system comprises a pressure sensor system for sensing an air pressure of an environment in which the fuse system is present, and thus in which a projectile comprising the fuse system is present. Significantly, the fuse system comprises a control system arranged to receive a signal from the pressure sensor system, and which is arranged to at least initiate arming of the fuse system conditional on the received signal. "At least initiate arming" might comprise actual arming, or starting an arming process.

A key feature is that a signal from the pressure sensor system is used in the arming. That is, this is not a mechanical movement of a pin or lever or similar, but is signal-driven. The signal could be hydraulic, but would typically be electrical in nature (which includes electromagnetic), which might provide more flexibility and ease of use. The use of signals, as opposed to purely mechanical means, vastly increases the possible types and sensitivities of the pressure sensor systems that can be used, and how these pressure sensor systems can be used. Therefore, while perhaps only subtly different to the use of purely mechanical means, the advantages are numerous and significant.

FIG. 2 schematically depicts more detail of a fuse system 6 in accordance with an example embodiment. The projectile 4 is shown. Located substantially within the projectile 4 is the fuse system 6. In general terms, the fuse system 6 comprises a pressure sensor system 10 for sensing an air pressure of an environment 12 in which the fuse system 6 (and thus the projectile 4) is present. The pressure sensor system 10 is in connection with a control system 14, in a wired or wireless manner. The control system 14 might take the form of a suitable computing processor or similar. The control system 14 is arranged to receive a signal from the pressure sensor system 10, and then arranged to initiate arming of the fuse system 6 conditional on the received signal. Typically, this will in some way comprise or involve arming of a fuse 16 of the fuse system 6 that is in connection with the control system 14, in a wired or wireless manner. In some embodiments, the fuse 16 might form part of the control system 14.

As discussed in more detail below and as will be appreciated by the skilled person, the pressure sensor system 10 and related control system 14 can take one of a number of different forms. However, and in terms of the general functionality, the system 6 as a whole will be arranged such that the condition for arming the fuse system is when the sensed pressure, or the related signal received from the pressure sensor system, is at or above a threshold which at least indicates that the projectile (or its fuse system) is in a launched or launching state (e.g. being fired, or in-flight). In other words, the pressure sensor system as disclosed herein might have general use, by way of advantageous application or implementation of signal-based control. However, in terms of being useful as a safety check or safety standard, use in relation to particular thresholds indicative of launch or launching will be very useful.

FIG. 3 shows that, in one example, the pressure sensor system 10 is arranged to sense a difference between a static air pressure 20, e.g. internal to the projectile 4, and a dynamic air pressure 22, e.g. of an (external) environment in which the projectile 4 is present. Such sensing may be achieved in one of a number of different ways, for example via a transducer 24 or related component located at an interface between a static pressure environment 20 and a dynamic pressure environment 22.

The use of static and dynamic pressure measurements is particularly useful, in that these measurements, and particular differentials or differences between these measurements, can provide accurate pressure measurements, irrespective of variations in ambient air pressure, temperature, altitude, etc.

FIG. 4 depicts a projectile 4 having a different embodiment of a pressure sensor system 30. In general terms, the pressure sensor system 30 comprises a pitot-static system. A pitot-static system is well established in other fields, rugged and relatively cheap and robust.

In the example shown in FIG. 4, the system comprises one or more ports and/or conduits 32 for facilitating fluid, e.g. gas, communication/connection between an environment external to the system 30 and projectile 4, and an environment internal to the system 30 and/or projectile 4. The ports and/or conduits 32 are positioned and generally arranged such that a dynamic pressure environment 34 is established (or communicated with or connected to) for sensing, and a static pressure environment 36 is established (or communicated with or connected to) for sensing.

As discussed in relation to FIG. 3, and also applicable to FIG. 4, the static and dynamic pressures can be used to obtain pressure information useful for initiating the arming of the fuse system. Conveniently, a differential pressure measurement may be obtained by locating a transducer 38 or similar component at an interface between the static 32 and dynamic 34 pressure environments. Again, as above, a differential measurement might be useful.

As in any embodiment, a transducer 38 or other signal-generating sensor in general may provide a signal to a control system for use in initiating arming of the fuse system, based conditionally on that signal.

It will be appreciated that the use of a signal, and in particular an electric signal, is particularly useful for the reasons already described above. Another reason is that this allows the field of MEMS devices to be exploited and generally used. This might be beneficial, since such devices are generally advantageous, in terms of costs, size, sensitivity, robustness, and their degree of already well-established development in the world of consumer devices. That is, a MEMS device may be taken from a different field and employed in use with a fuse system—the sensor may not need to be particularly designed for use in this application, which might reduce implementation costs.

It will be appreciated that the type of sensor that is used might depend on the operating conditions, thresholds, sensitivities, and so on that are required. In some examples, any pressure sensor that provides an output signal might be suitable, the use of the signal (as opposed to mechanical means) being advantageous as described above. A pitot-static system might be useful, since such technology is already widely used and very reliable, and generally simple, easy and cheap to implement. MEMS devices have been developed for consumer electronics purposes, to the extent that such MEMS sensors are particularly cheap, and yet very sensitive and very reliable, making them ideal for use in such applications as disclosed herein. Also, the of a pressure sensor which provides a signal, as opposed to working or interacting by purely mechanical means, means that the overall fuse system, and in particular pressure system itself, can be particularly simple, and small in volume, allowing it to be used in a very wide range of projectiles (sometimes referred to as munitions). For instance, the fuse system according to example embodiments might occupy a volume of less than or equal to 10 $cm^3$, or less than or equal to 5 $cm^3$. A pressure sensor system for use in conjunction with such a fuse system might occupy a volume of less than or equal to 5 $cm^3$, or less than or equal to 1 $cm^3$. This is simply not possible with pressure sensor-fuse arming systems operating on mechanical principles, which are far larger. A size reduction might also mean a weight reduction, which means a reduced impact on in-flight performance of the projectile.

As discussed above, it is likely that in order to meet safety requirements, or at least to provide general redundancy, the control system might require two conditions to be met in order to arm or initiate arming of the fuse system. FIG. 5 demonstrates this.

FIG. 5 is much the same as the projectile 4 and the fuse system 6 already shown in and described with reference to FIG. 2. However, in this example, the control system 14 is arranged to receive not one, but two inputs, in order to ensure that the fuse 16 of the system 6 is armed or initiated for arming when two conditions are met. So, much as with FIG. 2, FIG. 5 shows that a first condition might be when the pressure sensor system 10 provides a signal that is at least indicative of a certain pressure 12 threshold being met or exceeded, such a threshold typically being associated with the projectile 4 being fired, launched, or generally in an in-flight state. Advantageously, arming the fuse 16 of the system 6 may be based on a second condition, dependent on a signal received from a setback sensor system 40. The second condition for arming of the fuse system 6 is when the setback sensor system 40, or the related signal received from the setback sensor system 40, is at or above a threshold which at least implies or otherwise indicates that the projectile 4 is in a launched or launching state. As discussed previously, sensing a setback is independent of spin, which is advantageous. This is because some projectiles do not spin during launch or flight. Also, setback sensing is advantageous over many other sensing approaches, since setback will always be encountered during firing or launch of a projectile, and can be conveniently and simply measured internal to the projectile in a relatively simple way. Therefore, the combination of pressure sensing using a generated signal, and setback sensing, is not arbitrary but is instead advantageous. This is because the setback sensing provides a robust and well established approach to conditional arming of a fuse, whereas the pressure sensing and signal generation as discussed in detail herein provides a very useful, advantageous and independent second condition. The entire sensing system may use signals, as opposed to purely mechanical implementations.

An order of the sensing of a conditional pressure and a conditional setback may be useful as a validation method. For example, for the application in question, acceleration (setback) should always be detected or sensed first, followed by the pressure that is indicative of the projectile having been launched, and never the other way round. If the order of sensing is not as expected, the control system may be arranged to not arm, or to prevent arming, or disarm the fuse system. This ordering could, indeed, be a third condition for arming.

As discussed herein, the projectile in which the fuse system is located or otherwise provided may be any projectile where such advantageous use of a system might be desirable. However, the fuse system might find particularly advantageous use in a projectile which is not typically spinning during firing or flight, for example a mortar bomb (sometimes referred to as mortar round) or smooth bore round. The invention might find even more particular use in conjunction with a mortar bomb, since such mortar bombs are typically relatively crude, do not spin, and do not travel at particularly high speeds, all of which present problems for prior art approaches. The present invention overcomes these problems, and therefore finds particular use with such mortar bombs.

FIG. 6 schematically depicts general methodology associated with the present invention. FIG. 6 shows a fuse system 50 for a projectile for a ranged weapon. The fuse system 50 comprises a pressure sensor system 52 for sensing an air pressure of an environment in which the fuse system is present. The fuse system 50 further comprises a control system 54 arranged to receive a signal 56 from the pressure sensor system 52, and which is also arranged to initiate arming of the fuse system 50 conditional on that received signal 56.

In a related manner, FIG. 7 describes general methodology associated with the present invention. A method of arming a fuse system of a projectile for a ranged weapon is provided. The method comprises detecting an air pressure of an environment in which the fuse system is present, using a pressure sensor system 60. The method further comprises initiating arming of the fuse system conditional on a signal received from the pressure sensor system 62.

In the above description, the term "fuse" has been used. Sometimes this term might be used interchangeably with the related term or synonymous term "fuze". It will be understood that in the context of understanding this disclosure these terms might be used entirely interchangeably, and are generally given the same meaning in everyday usage. However, some interpretations are such that "fuze" is perhaps a more specific term for a device or system including or in connection with explosive components designed to initiate a charge or something similar. "Fuse" might be a component within the fuze system, for example, the part of the system that is armed to ignite or initiate a explosive component or charge or similar.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A fuse system for a projectile for a ranged weapon, the fuse system comprising:

a setback sensor system configured to measure an acceleration of the projectile and generate a first electronic signal based on the measured acceleration;

a pressure sensor system configured to sense a differential air pressure of an environment in which the fuse system is present and generate a second electronic signal based on the sensed differential air pressure; and a control system arranged to receive the first electronic signal from the setback sensor system and the second electronic signal from the pressure sensor system, and to at least initiate arming of the fuse system in response to detecting that the first electronic signal is above a first threshold and, only after detecting that the first electronic signal is above the first threshold, detecting that the second electronic signal is above a second threshold.

2. The fuse system of claim 1, wherein the second threshold is associated with a differential air pressure that at least implies that the projectile is in a launched or launching state.

3. The fuse system of claim 1, wherein the pressure sensor system is arranged to sense: a static air pressure of an environment in which the fuse system is present; and/or a dynamic air pressure of an environment in which the fuse system is present.

4. The fuse system of claim 1, wherein the pressure sensor system is arranged to sense a difference between a static pressure of an environment in which the fuse system is present and a dynamic air pressure of an environment in which the fuse system is present.

5. The fuse system of claim 1, wherein the pressure sensor system comprises a pitot-static system.

6. The fuse system of claim 1, wherein the pressure sensor system comprises a MEMS pressure sensor.

7. The fuse system of claim 1, wherein the pressure sensor system comprises one or more ports and/or conduits for facilitating fluid communication with an external environment in which the fuse system is present.

8. The fuse system of claim 1, wherein the fuse system occupies a volume of less than or equal to 10 $cm^3$, or less than or equal to 5 $cm^3$.

9. The fuse system of claim 1, wherein the pressure sensor system occupies a volume of less than or equal to 5 $cm^3$.

10. A projectile for a ranged weapon, the projectile comprising the fuse system of claim 1.

11. The projectile of claim 10, wherein the projectile is a mortar bomb.

12. The fuse system of claim 1, wherein the first threshold is associated with an acceleration that at least implies that the projectile is in a launched or launching state.

13. The fuse system of claim 1, wherein the fuse system occupies a volume of less than or equal to 5 $cm^3$.

14. A method of at least initiating arming of a fuse system of a projectile for a ranged weapon, the method comprising:

measuring an acceleration of the projectile using a setback sensor system and generating a first electronic signal based on the measured acceleration;

detecting an air pressure of an environment in which the fuse system is present using a pressure sensor system and generating a second electronic signal based on the detected air pressure; and at least initiating arming of the fuse system in response to detecting that the first electronic signal is above a first threshold and, only after detecting that the first electronic signal is above the first threshold, detecting that the second electronic signal is above a second threshold.

15. The method of claim 14, wherein detecting the air pressure of the environment in which the fuse system is present includes generating one or more electrical signals indicative of a difference between an air pressure internal to the projectile and an air pressure external to the projectile, and wherein arming of the fuse system is initiated in response to the difference between the internal and external air pressures exceeding the second threshold.

16. A fuse system for a projectile for a ranged weapon, the fuse system comprising:

a first sensor system configured to measure an acceleration of the projectile and generate a first electronic signal based on the measured acceleration;

a second sensor system configured to generate a second electrical signal indicative of a difference between an air pressure internal to the projectile and an air pressure external to the projectile; and a control system arranged to receive the first and second electrical signals, and to at least initiate arming of the fuse system in response to detecting that the first electronic signal is above a first threshold and, only after detecting that the first electronic signal is above the first threshold, detecting that the second electronic signal is above a second threshold.

17. The fuse system of claim 16, wherein: the second sensor system comprises a pitot-static system, a MEMS pressure sensor, or one or more ports and/or conduits for facilitating fluid communication with an external environment in which the fuse system is present.

18. The fuse system of claim 16, wherein the fuse system occupies a volume of less than or equal to 10 cm3.

19. A projectile for a ranged weapon, the projectile comprising the fuse system of claim 16.

20. The projectile of claim 19, wherein the projectile is a mortar bomb.

* * * * *